United States Patent [19]

Miller

[11] Patent Number: 4,989,777

[45] Date of Patent: Feb. 5, 1991

[54] PORTFOLIO

[76] Inventor: Harold L. Miller, 8245 N. 27th Ave., Apt. 1059, Phoenix, Ariz. 85021

[21] Appl. No.: 408,748

[22] Filed: Sep. 18, 1989

[51] Int. Cl.[5] ..... B65D 27/08

[52] U.S. Cl. ..... 229/1.5 R; 229/72; 229/DIG. 3

[58] Field of Search ..... 229/72, 1.5 R, DIG. 3, 229/87 R, 87 A, 87.5, 75, 68 R, 84; 281/31; 150/147; 40/405

[56] References Cited

U.S. PATENT DOCUMENTS

| | | | |
|---|---|---|---|
| 646,638 | 4/1900 | Cutler | 229/75 |
| 1,042,488 | 10/1912 | Shaffer | 229/DIG. 3 |
| 1,194,440 | 8/1916 | Swortfiguer | 229/DIG. 3 |
| 1,465,619 | 8/1923 | Alling | 229/87.5 |
| 2,374,005 | 4/1945 | Fisler | 229/84 |
| 2,436,105 | 2/1948 | Fisler | 229/1.5 R |
| 2,568,131 | 9/1951 | Segal | 281/29 |
| 3,186,629 | 6/1965 | Tucker | 229/72 |
| 3,516,599 | 6/1970 | Buttery | 229/72 |
| 4,295,599 | 10/1981 | Locatelli et al. | 229/123 |
| 4,301,962 | 11/1981 | Monckton et al. | 229/72 |
| 4,466,638 | 8/1984 | Miskin | 281/33 |
| 4,583,764 | 4/1986 | Steffen | 281/31 |
| 4,629,349 | 12/1986 | Pitts | 402/74 |
| 4,636,179 | 1/1987 | Gentile et al. | 402/79 |

FOREIGN PATENT DOCUMENTS

| | | | |
|---|---|---|---|
| 481545 | 12/1916 | France | 229/75 |

*Primary Examiner*—Stephen P. Garbe

*Attorney, Agent, or Firm*—Charles E. Cates; Richard G. Harrer

[57] ABSTRACT

A portfolio or presentation folder having one or more expandable pockets which can be manufactured from a single piece of appropriate sheet material is disclosed. Each pocket is formed in a portion of the cover of the portfolio and by a pair of flaps, each flap being integral with the main body of each of the portfolio covers. One flap is positioned at a side of the portfolio cover and the other flap is positioned along a bottom edge of the portfolio cover. Thereafter, the side and bottom flaps are folded in such a manner that the side flap is sandwiched between sections formed in the bottom flap and an expandable pocket is formed without the use of adhesives or other fastening means.

4 Claims, 2 Drawing Sheets

FIG. 1
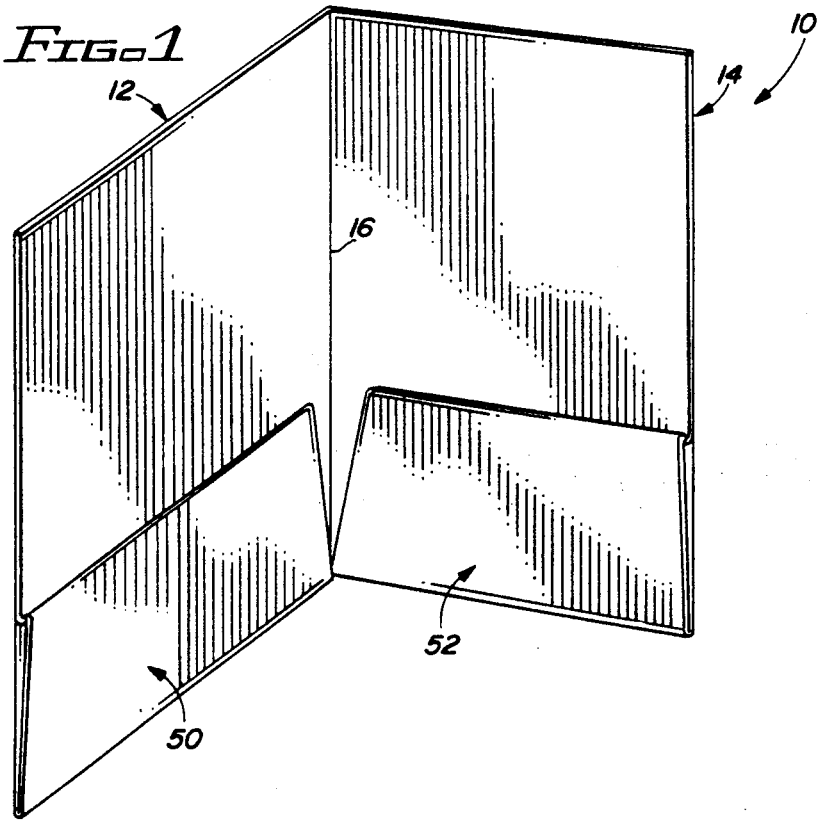
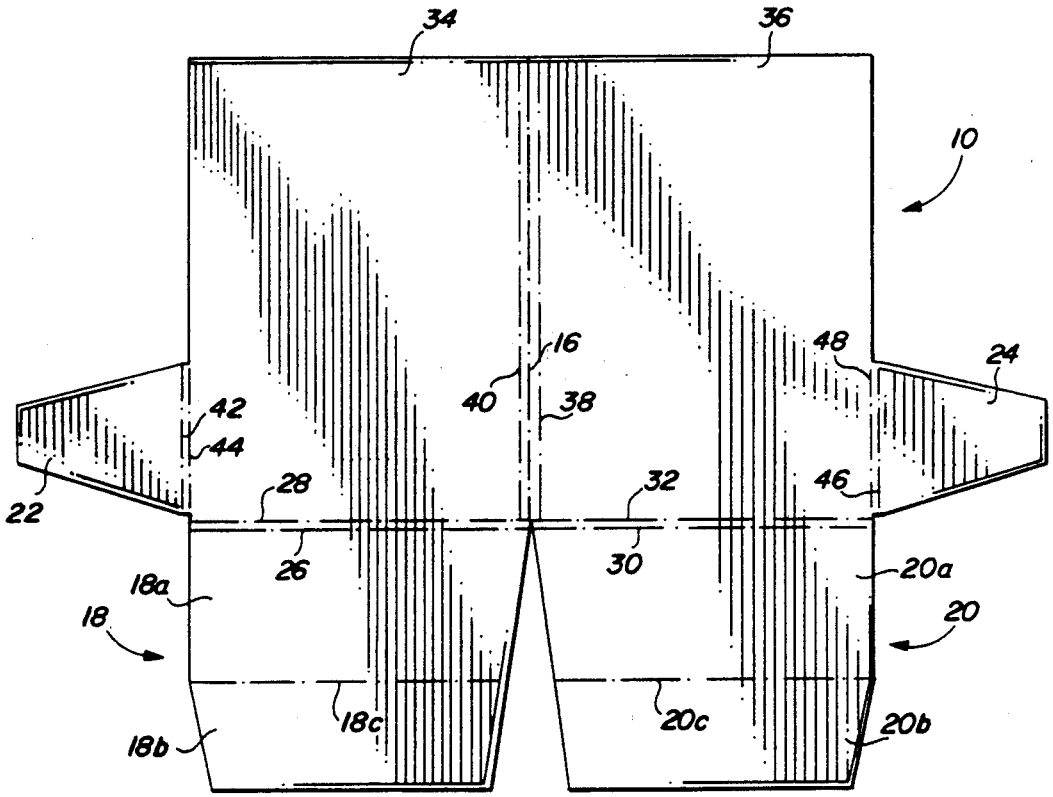
FIG. 2

PORTFOLIO

This invention relates to improved portfolios or presentation folders as used in the business of office supplies.

BACKGROUND OF THE INVENTION

In the field of office products and supplies it is common to find presentation folders or portfolios which are used to present organized papers and the like. Such portfolios can be described as usually consisting of a front and back cover which are hingedly secured one to the other, with the interior side of one or both of the covers provided with a pocket to receive loose sheets, clippings, memos, notes, photographs and the like. Such portfolios or presentation folders are customarily made of sheet stock such as Manilla stock, kraft stock, pressboard or even sheet plastic such as vinyl plastic with the thicknesses of such stock materials ranging from about 9 points to about 25 points (each point representing 0.001 inch) in thickness.

Such portfolios are customarily made from sheet stock material by die cutting the sheet. The die that is used is such that the sheet material is cut so that one or two flaps are formed at one end of the sheet material. In assembling the portfolio, the flap is then folded upwardly on the interior side of one or both covers, and then the edges of the flaps are adhesively secured to the interior side of the cover. Thus, a pocket is formed on the side of the interior of the portfolio.

Although such portfolios as described are generally satisfactory, they do have shortcomings in that since the pockets are formed by adhesively securing edges of the flap to the interior of the covers which requires an additional and costly processing step in their manufacture. Additionally, when the pockets are formed by adhesively securing the flaps, the expandability of the pockets is limited, particularly when standard size sheets of paper are to be inserted into the respective pockets. Thus, it is often necessary to use more than one portfolio to accommodate the required papers.

OBJECTS OF THE INVENTION

It is therefore an object of this invention to provide a portfolio in which the pockets thereof are easily expandable to accommodate varying amounts of papers and the like.

It is a further object of this invention to provide a portfolio which can be manufactured from a single piece of appropriate sheet material and which does not require the use of adhesives or other fastening means to provide expandable pockets therein.

These and other objects of this invention will be apparent with the following description and claims.

BRIEF SUMMARY OF THE INVENTION

The foregoing and other objects of this invention are achieved by providing a portfolio having one or more pockets each formed therein by a portion of the cover of the portfolio and by a pair of flaps, each flap being integral with the main body of each of the portfolio covers. One of the flaps is positioned at a side of the portfolio cover and the other flap is positioned along a bottom edge of the portfolio cover. Thereafter, the side and bottom flaps are folded in such a manner that the side flap is sandwiched between sections formed in the bottom flap and an expandable pocket is formed without the use of adhesives or other fastening means.

BRIEF DESCRIPTION OF THE DRAWINGS

FIG. 1 is a perspective view of a portfolio having two expandable pockets;

FIG. 2 is a plan view of a piece of sheet stock which has been appropriately cut to form the various components of the portfolio;

DETAILED DESCRIPTION OF THE INVENTION

Figure 3A:
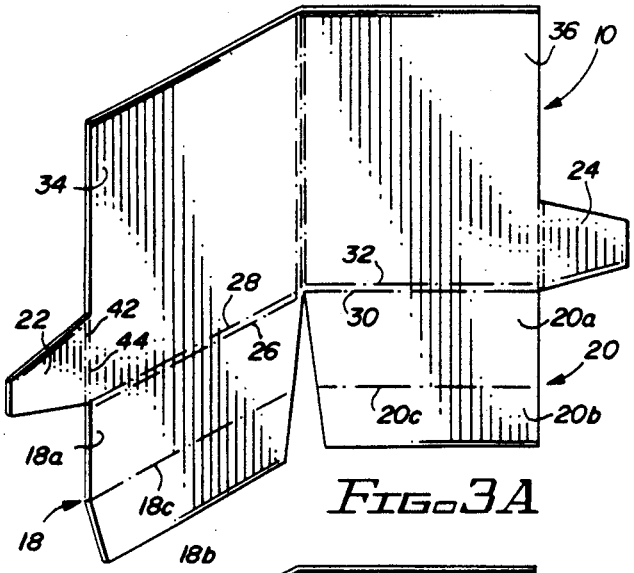
FIGS. 3A–3D are partial perspective views showing the steps involved in forming the pockets of the portfolio.
Figure 3D:
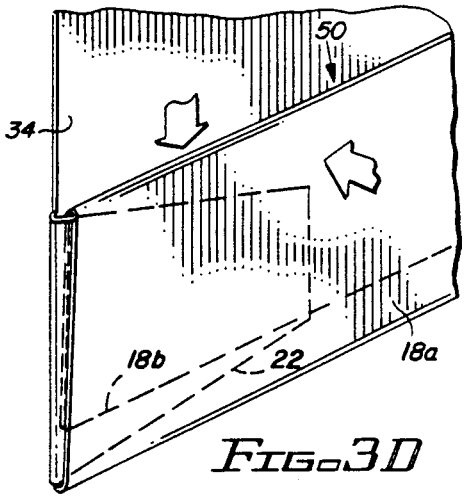

A preferred embodiment of the portfolio 10 of this invention is shown in perspective in FIG. 1 and includes generally a front cover 12 and back cover 14 which are hingedly secured one to the other at crease line 16 and having expandable pockets shown generally at 50 and 52. Papers and other items are readily retained in the expandable pockets.

The components of the portfolio FIG. 1 is best shown in FIG. 2. A piece of appropriate material such as Manilla stock, kraft stock, sheet plastic and the like usually having a thickness ranging from about 0.009 to about 0.025 inches has been die cut to form the unitary piece shown in FIG. 2. This sheet piece 10 comprises generally rectangular shaped main panels 34 and 36 with crease lines or score lines 16, 38 and 40 separating the panels 34 and 36. The main panels 34 and 36 when folded one on the other form the front and back covers 12 and 14 of the portfolio. At the bottom edge 28 of panel 34 is a flap 18 separated from panel 34 by crease lines 26 and 28 and comprising sections **18*a* and 18*b*, sections 18*a* and 18*b* being separated by crease line 18*c*. Correspondingly, at the bottom edge 32 of main panel 36 is another flap 20 separated from panel 36 by crease lines 30 and 32 and comprising sections 20*a* and 20*b*, the sections being separated by crease line 20*c***.

As shown in FIG. 2, each of main panels 34 and 36 is also provided with side flaps 22 and 24 with the side flaps being separated from the main panels 34 and 36 by crease lines 42, 44, 46, and 48 respectively. It will be also seen that side flaps 22 and 24 extend outwardly from panels 34 and 36 at approximately a right angle to the corresponding bottom flaps. It will also be understood that each of the bottom and side flaps are easily folded by virtue of the various crease lines in a direction toward the main panels of the portfolio.

Figure 3B:
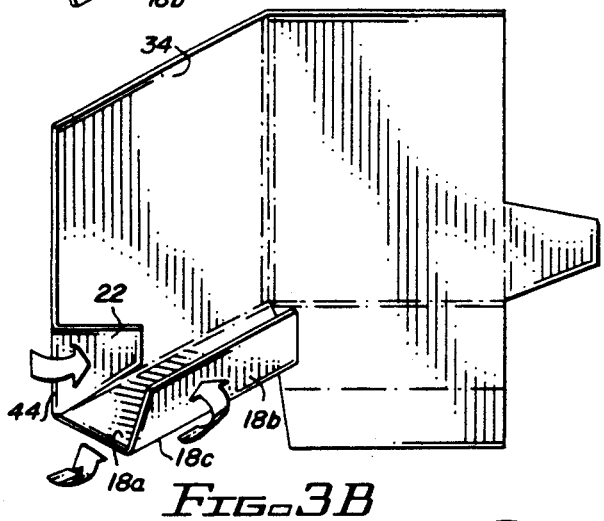

The formation of a completed portfolio is accomplished as shown in FIGS. 3A–3D. Starting with the die cut piece shown in FIG. 3A, the first steps are as shown in FIG. 3B to bend side flap 22 a distance toward main panel 34 along crease line 44. Thereafter, the bottom flap 18 is bent upwardly along crease line 28 toward main panel 34. At about the same time, section **18*b* of the bottom flap is also bent along crease line 18*c*, again in a direction toward the main panel 34. As shown best in FIG. 3C, the lower section 18*b* of the bottom flap is then directed behind side flap 22 and between side flap 22 and main panel 34. This bending and folding process is shown as being completed in FIG. 3D wherein pocket 50 is completely formed with side flap 22 being sandwiched between sections 18*a* and 18*b* of the bottom flap. It will be understood that side flap 22 really serves a two fold purpose. It serves to hold the side of the pocket formed by section 18***a* and 18*b* against the main panel 34 and also serves as a gusset allowing the pocket to expand but at the same time preserving the pocket and not allowing it to come apart. Thus, as more papers and the like are inserted into pocket 50, the side of pocket 50 formed by sections 18*a* and 18*b* of the bottom flap 18 will move away from the main panel 34 and along flap 22. This expansion occurs without any bending of the pocket as is customary in folders wherein the pocket is formed by adhesively securing parts thereto as earlier described. Thus a considerable amount of papers and the like can be inserted into the pockets of this improved portfolio.

Figure 4A:
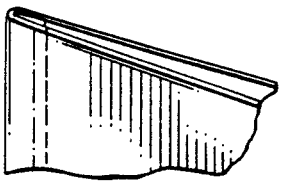
FIGS. 4A and 4B are partial views of the hinge area of the covers of the portfolio showing increased expandability of this area of the covers of the portfolio.
Figure 4B:
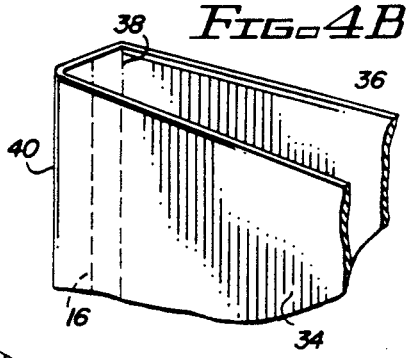
Figure 3C:
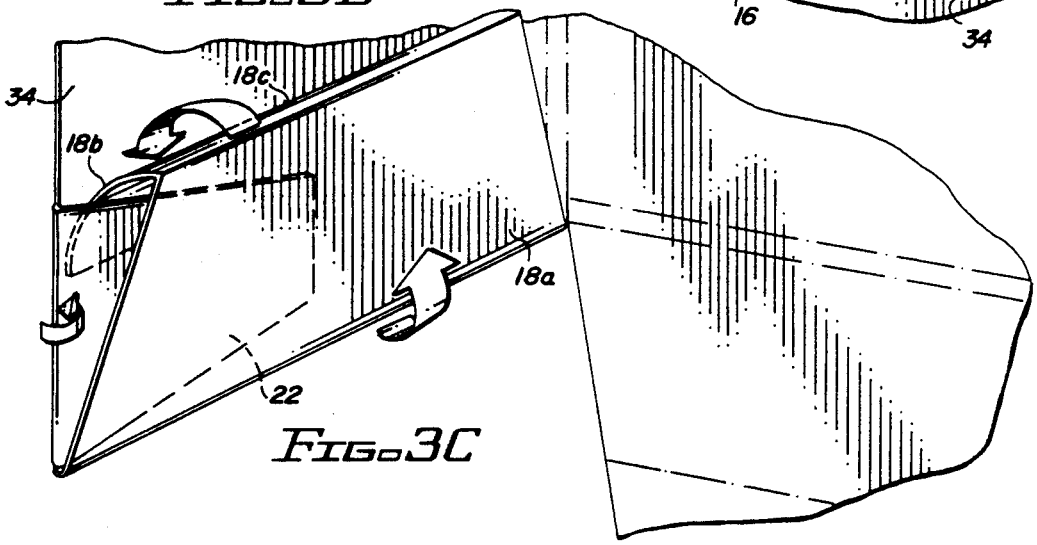

In its most preferred embodiment the portfolio employs multiple crease or score lines as shown best in FIG. 2. Thus, for example, the presence of the additional crease lines 38 and 40 between main panels 34 and 36 provides for additional expandability in the completed portfolio. In FIG. 4A, the covers 12 and 14 have been folded along crease line 16. However, as shown in FIG. 4B, the presence of crease lines 38 and 40 allow the completed portfolio to expand in an orderly fashion. The same is true for the additional crease lines provided for the side and bottom flaps.

It will be appreciated that changes can be made in the portfolio as described without departing from the spirit of this invention. For example, the portfolio may be made with a pocket provided in only one of the covers. Additionally, the portfolio may be provided with a fastening means along with a conventional paper fastener mounted in the interior of the portfolio along the hinge or crease line 16.

I claim:

1. A portfolio for holding and displaying papers and the like, said portfolio having a front and back cover hingedly secured one to the other, with at least one of said covers provided with an expandable pocket, the first side of said pocket formed by a portion of said cover and the second side of said pocket formed by a flap extending along a bottom edge of said cover and a flap positioned on a side of said cover, said bottom flap further comprising a first section immediately adjacent the bottom edge of said cover and a second section immediately adjacent said first section and wherein said side flap is sandwiched between said sections of said bottom flap in a manner such that said second section of said bottom flap is on the inside of said pocket.

2. The portfolio of claim 1 wherein said side flap serves as a gusset allowing said pocket to expand.

3. The portfolio of claim 2 wherein each of the covers of said portfolio is provided with a pocket.

4. The portfolio of claim 3 wherein said portfolio is formed of a unitary piece of sheet material having a thickness ranging from about 0.009 to about 0.025 inches and wherein said flaps are provided with crease lines to aid in folding said flaps and forming said pocket.

* * * * *